US005404896A

United States Patent [19]

Howe

[11] Patent Number: 5,404,896

[45] Date of Patent: Apr. 11, 1995

[54] TENT WITH RING HOLDERS FOR HOLDING AND ALIGNING TENT RINGS

[76] Inventor: Robert H. Howe, 1872 Clemens Ave., Oakland, Calif. 94607

[21] Appl. No.: 263,044

[22] Filed: Jun. 21, 1994

[51] Int. Cl.[6] ..... E04H 15/40

[52] U.S. Cl. ..... 135/125; 135/119; 135/905

[58] Field of Search ..... 135/102, 104, 105, 106, 135/109, 114, 115, 119, 905

[56] References Cited

U.S. PATENT DOCUMENTS

| | | | |
|---|---|---|---|
| 2,939,468 | 7/1960 | Boyce | 135/15 |
| 3,446,523 | 5/1969 | Little | 287/58 |
| 3,863,659 | 2/1975 | Gillis | 135/4 R |
| 3,986,519 | 10/1976 | Gillis | 135/3 E |
| 4,111,217 | 10/1978 | Victor | 135/15 PQ |
| 4,195,651 | 4/1980 | Watts et al. | 135/2 |
| 4,265,259 | 5/1981 | Gillis | 135/1 R |
| 4,265,260 | 5/1981 | Gillis | 135/3 R |
| 4,706,696 | 11/1987 | Gillis | 135/102 |
| 4,716,918 | 1/1988 | Hayashida et al. | 135/93 |
| 4,827,958 | 5/1989 | Cantwell et al. | 135/104 |
| 5,197,504 | 5/1993 | Howe | 135/102 |
| 5,333,634 | 8/1994 | Taylor | 135/119 X |

*Primary Examiner*—Lanna Mai
*Attorney, Agent, or Firm*—David Pressman

[57] ABSTRACT

An easy-to-assemble tent includes supporting poles (10) and a flexible sheet barrier (12) having D-rings (23) attached thereon along pole paths. When the tent is collapsed, the rings along each pole path are slidably stacked along a robe-shaped ring holder (24), and locked thereon by a locking D-ring (22) positioned on top of the stack. Each pole can be easily positioned into all of the rings along a pole path in one step by inserting it into the ring holder, so that the user will not have to thread the poles into the rings one at a time or have to remember the pole paths. When the poles are inserted into the ring holders, the tent can be erected by unlocking the locking ring, bending the poles, and sliding the rings along the poles into position. The tent can also be collapsed and disassembled by sliding and locking the rings onto the ring holders, and removing the poles therefrom. The poles and the sheet barrier can thus be transported separately by two or more people for sharing the load, and for more compact storage.

20 Claims, 4 Drawing Sheets

TENT WITH RING HOLDERS FOR HOLDING AND ALIGNING TENT RINGS

BACKGROUND OF THE INVENTION

1. Field Of The Invention

This invention relates generally to tents, specifically to an improved tent with supporting poles and mating canvas rings.

2. Prior Art

Camping or backpacking tents are small, portable shelters that generally include a flexible sheet barrier suspended by several intersecting hoop-shaped poles to form a dome with flat sections (polyhedral Shapes). Examples of such tents are shown in U.S. Pat. No. 3,863,659 to Gillis (1975), 4,716,918 to Hayashida et al. (1988), and 4, 827,958 to Cantwell et al. (1989). The poles are bent and extended through rings distributed along the arched sheet barrier or canvas. A typical tent is stored completely disassembled: the poles are disconnected from the sheet barrier. It is erected by laboriously sliding each of the poles through the rings along a path of rings one ring at a time, much like threading a shower rod through the rings of a shower curtain. Because the pole or ring paths intersect each other, the poles can be easily threaded through rings on the wrong path. Assembling the tent is thus a confusing and time consuming trial-and-error process. Smooth assembly can only be achieved with enough experience and by remembering the complex pole paths. My U.S. Pat. No. 5,197,504 (1993) shows a tent with poles that each include a retainer or stop member attached to one end for preventing the rings from sliding off. Each pole remains threaded in its rings along the correct pole path, so that the tent can be easily erected by simply sliding the rings along the poles, without having to thread the poles through the rings one at a time. As a result, the speed and ease of erecting the tent are greatly improved. However, this requires the poles and the barrier to be stored together, and therefore transported by a single person.

OBJECTS AND ADVANTAGES

Accordingly several objects and advantages of the present invention are to provide an improved tent structure, to provide a tent which can be very quickly assembled and erected without requiring a user to remember the pole paths, which have poles separable from the sheet barrier for transportation by more than one person to reduce the lead on each person, and also for more compact storage. Further objects and advantages of the invention will become apparent from a consideration of the drawings and ensuing description.

SUMMARY OF THE INVENTION

These objects and advantages are achieved with a ten/having multiple supporting poles and a flexible sheet barrier having rings distributed along multiple intersecting pole paths. The poles are bent in arches and threaded into the rings to support the tent in an erected condition. The tent is collapsed and disassembled by sliding and locking all the rings along each pole onto a ring holder fitted to an end thereof. The poles are removed from the ring holders—which keep the rings coaxially together—so that the poles and sheet barrier can be stored and transported separately. The tent can be quickly and easily assembled by sliding the poles into their respective ring holders, releasing the rings from their holders, and sliding the rings along the poles.

Figure 1:
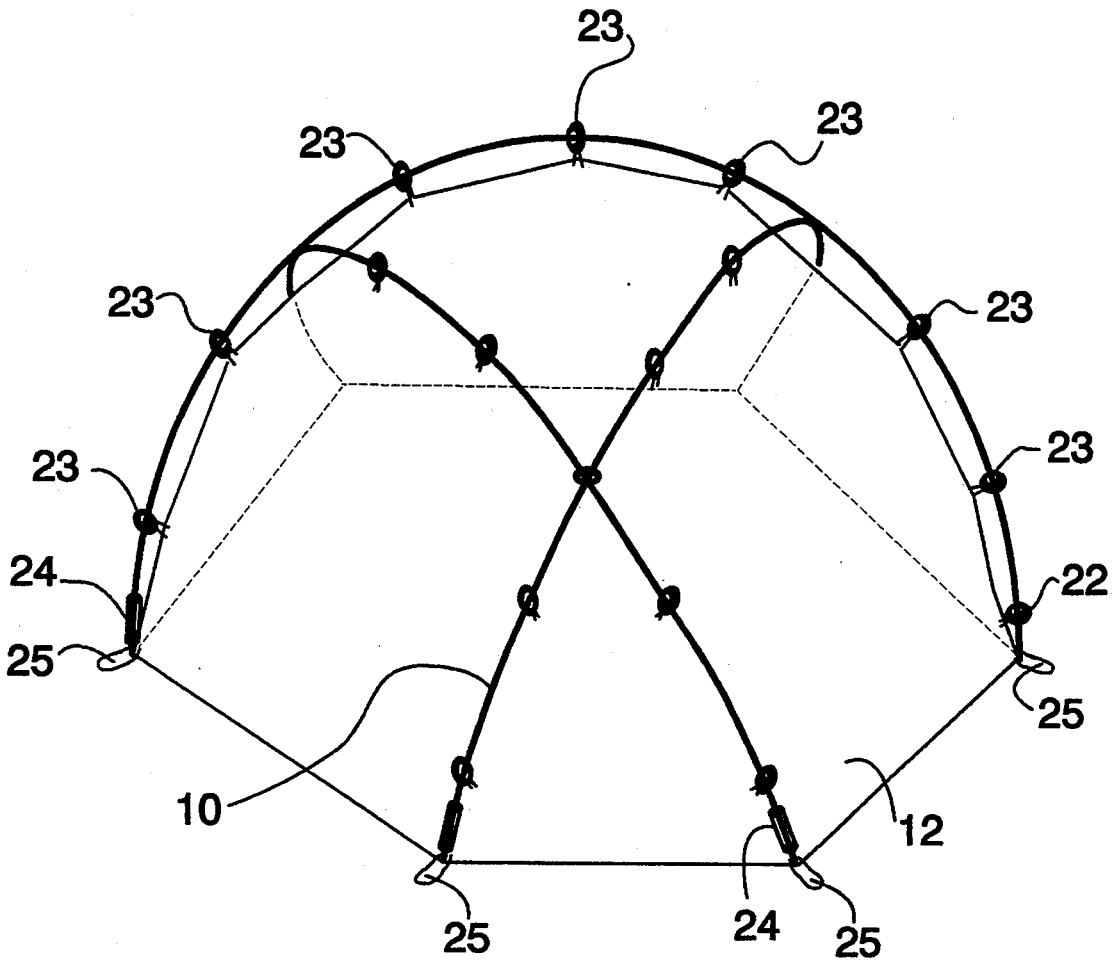
FIG. 1 is a front perspective view of a tent in accordance with a preferred embodiment of the invention.

| Drawing Reference Numerals | |
|---|---|
| 10. Pole | 12. Sheet Barrier |
| 22. Locking Ring | 23. D-Ring |
| 24. Ring Holder | 25. Bottom Web |
| 26. Tip Member | 27. Neck of Tip Member |
| 28. Finger Grips | 29. Leaf Spring Portions |
| 30. Locking Tab | 31. Intermediate Web |
| 32. Tapered Top Of Ring Holder | 33. Slot On Ring Holder |
| 34. Stop On Ring Holder | 35. Rectangular Ring On Ring Holder |
| 36. Anti-Withdrawal Flaps | |
| 38. Hole In Anti-Withdrawal Flaps | 37. Grommet On Bottom Web |

DESCRIPTION—FIG. 1—TENT

In accordance with a preferred embodiment of the invention shown in the front perspective view in FIG. 1, a tent includes three flexible poles 10, each of which is inserted through multiple D-shaped rings 23 and one D-shaped locking end ring 22. The rings are attached along three intersecting paths on the surface of a flexible sheet barrier or canvas 12. Each end of each pole 10 is also inserted through a bottom web or strap 25; the webs are distributed along the bottom edge of barrier 12. Each pole 10 also includes a ring holder 24 just above the one end thereof. The normally straight poles 10 are bent in arches to suspend barrier 12 thereunder and to keep it in tension in a polyhedral shape.

Figure 2A:
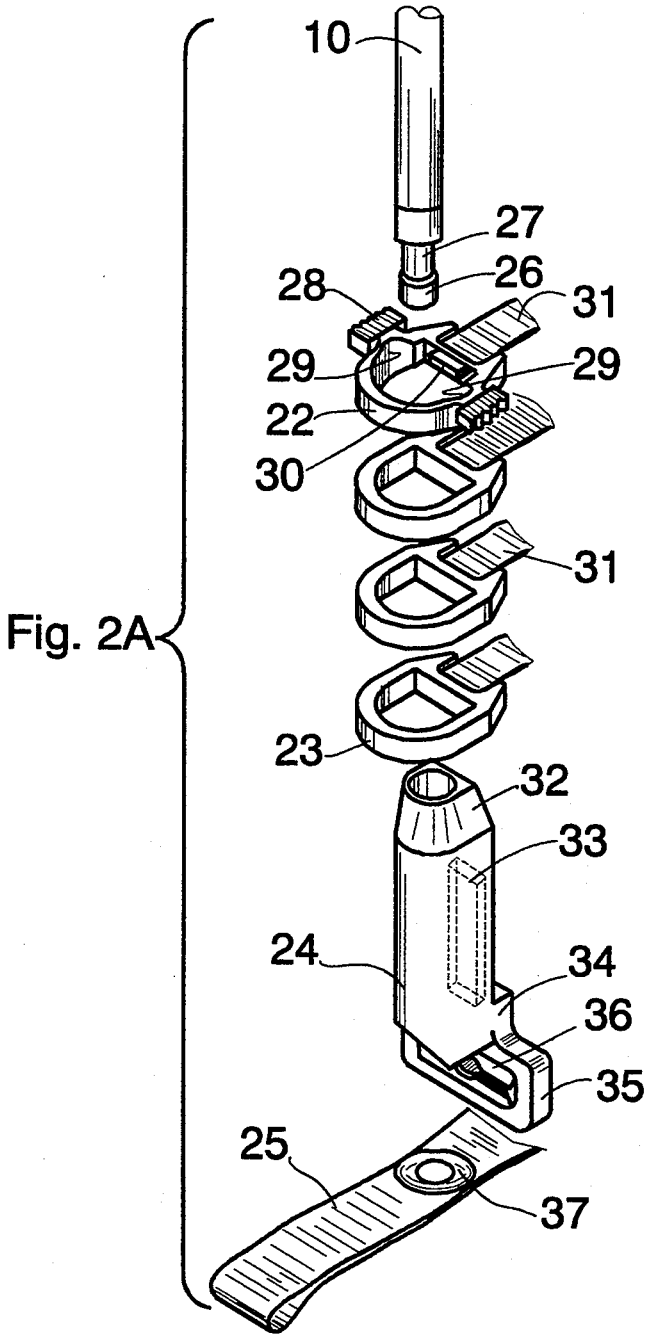
FIG. 2A is a front perspective exploded view of a support pole, tent rings, and a ring holder of the tent.
Figure 2B:
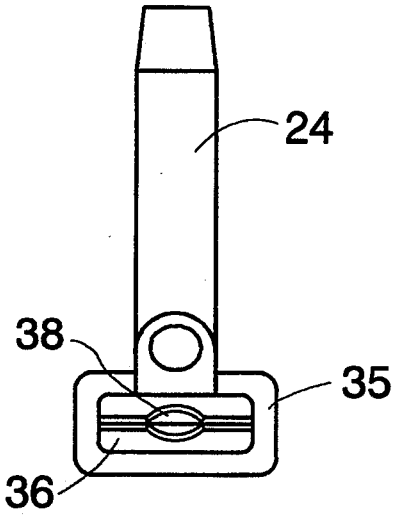
FIG. 2B is a front view of the ring holder.

DESCRIPTION—FIGS. 2A and 2B—Pole, Rings, And Ring Holder

As shown in the exploded view in FIG. 2A, pole 10 includes a button or tip member 26 having a narrow neck 27. Locking ring 22 includes a pair of finger grips 28 attached to two outwardly bowing leaf-spring portions 29, and a locking tab 30 extending inwardly from the straight side of the "D." Locking ring 22 is made of a resilient plastic material so that it can be deformed and lengthened by squeezing finger grips 28. Locking ring 22 and rings 23 are each connected to an intermediate web or strap 31 which is in turn attached to sheet barrier 12 (FIG. 1).

Elongated ring holder 24 has a D-shaped cross section (as shown at its top end) sized for slidably fitting into and aligning locking ring 22 and rings 23. Ring holder 24 has a tapered top end 32, a slot 33 on its flat rear side, a stop-member 34 adjacent its lower end, and a rectangular ring 35 extending downwardly from its lower end. Rectangular ring 35 includes a pair of inwardly extending, anti-withdrawal flaps 36. Bottom web 25 includes a grommet 37 disposed thereon.

As shown in the front view of ring holder 24 in FIG. 2B, an elliptical hole 38 is formed by opposite cutouts in flaps 36.

OPERATION—FIGS. 3A TO 3C—ASSEMBLY AND DISASSEMBLY

Figure 3A:
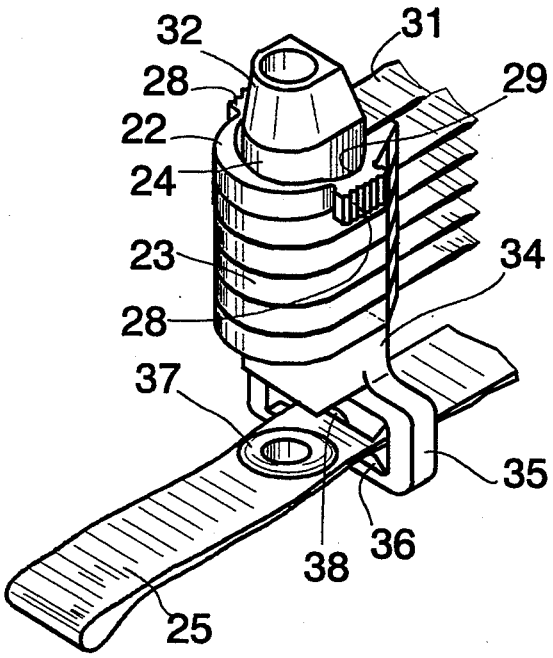
FIG. 3A is a front perspective view of the tent rings fitted onto the ring holder.
Figure 3B:
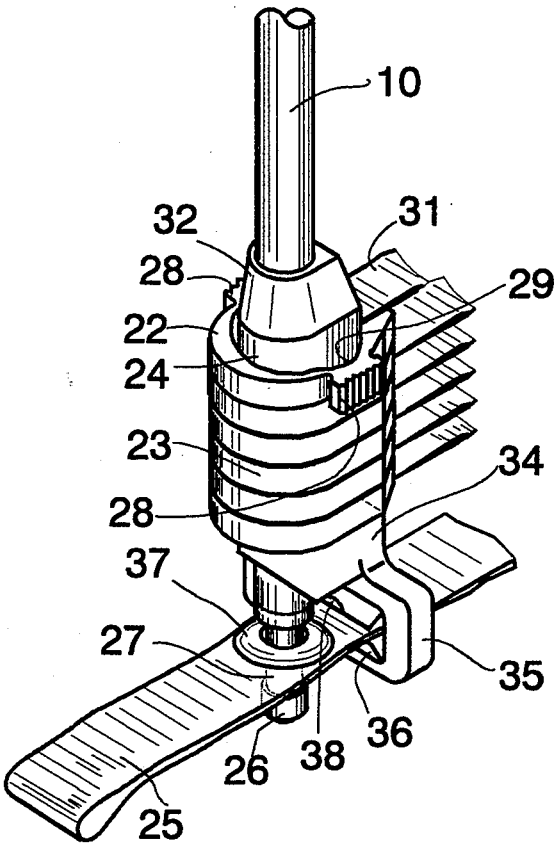
FIG. 3B is a front perspective view of the pole tilled into the ring holder and rings.
Figure 3C:
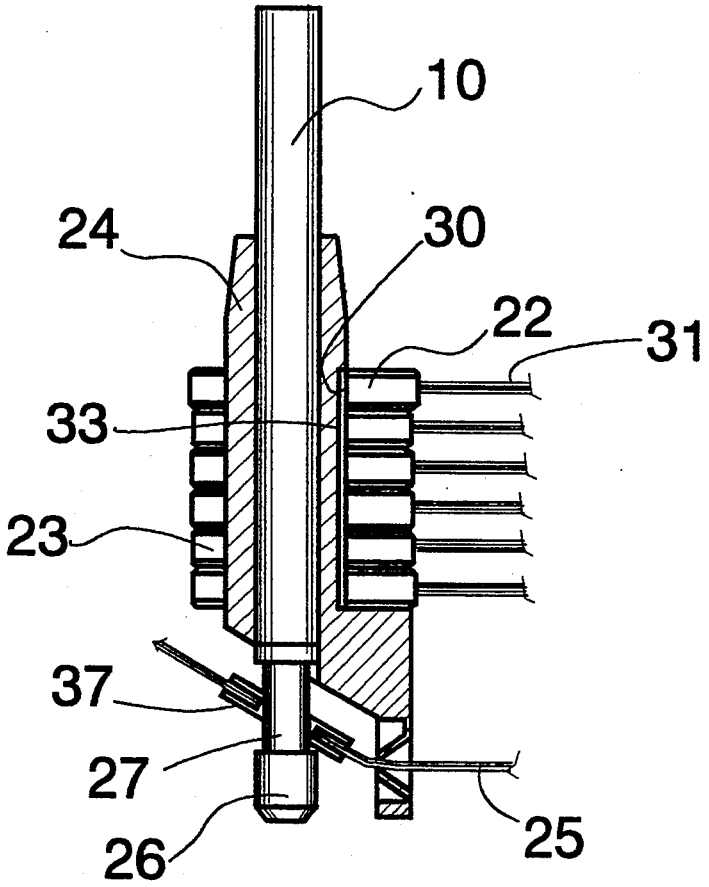
FIG. 3C is a side sectional view of the tent rings and ring holder.

As shown in the front perspective view in FIG. 3A, the tent is assembled by inserting bottom web 25 through flaps 36 of rectangular ring 35. Hole 38 in flaps 36 allows grommet 37 to pass therethrough. Once web 25 is inserted, flaps 36 will prevent it from being easily withdrawn. Rings 23 are then pushed onto and around ring holder 24 until the lowermost ring engages stop member 34. When locking ring 22 is pushed onto ring holder 24, inwardly protruding locking tab 30 (FIG. 3C) causes the resilient ring to become slightly deformed when it is pushed past tapered top end 32, until locking tab 30 (FIG. 3C) snaps into the top end of slot 33 (FIG. 3C). Locking ring 22 and rings 23 are thus locked onto ring holder 24. This preliminary assembly process can be done at the factory to reduce the users' work.

When the rings are thus locked in ring holder 24, the tent is collapsed and the sheet barrier (not shown) is crumpled. When poles 10 (FIG. 3B) are still separated from the sheet barrier, they can be transported separately by two or more people, thereby lightening the load for each person. As shown in the front perspective view in FIG. 3B, a user can assemble the tent by inserting pole 10 into ring holder 24 until neck 27 of tip member 26 passes through grommet 37. The center of grommet 37 is slightly offset from the centerline of pole 10, so that grommet 37 will snap into neck portion 27 when tip member 26 passes through the grommet. In prior-art tents, the poles had to be threaded through one ring at a time along the correct pole path—a process that was time consuming and fraught with opportunities for error. In the present tent, pole 10 is inserted through all the rings in one quick and simple step when it is inserted through ring holder 24, which already holds all the rings in a coaxial stack. As a result, the user will not have to remember the pole path to assemble the tent, so that assembly will be greatly facilitated.

When locking ring 22 is installed on ring holder 24, its leaf-spring portions 29 (one shown in FIG. 3B) are spaced apart from the side of ring holder 24. The tent can be erected by squeezing finger grips 28 to flatten leaf-spring portions 29, thereby deforming and lengthening locking ring 22 until locking tab 30 (FIG. 3C) disengages from slot 33 (FIG. 3C) of ring holder 24. Pole 10 is then bent into an arch (FIG. 1 ), and locking ring 22 slid along the pole until it reaches its position at the opposite end of the pole. Sliding locking ring 22 into position will automatically deploy all rings 23 into their respective positions, as shown in FIG. 1. The tent can be easily collapsed and disassembled by sliding locking ring 22 and all rings 23 along pole 10 and Onto ring holder 24. As shown in FIG. 3C, when the rings are being pushed downwardly on ring holder 24, the ring holder will be pushed downwardly with respect to pole 10. I.e., pole 10 will move upwardly with respect to ring holder 24, so that the edge of neck portion 27 on pole 10 will pull grommet 37 upwardly until it engages the angled bottom end of ring holder 24. When all the rings are locked in place, pole 10 can be slidably removed from ring holder 24 by first pulling bottom web 25 and grommet 37 so that it is perpendicular to pole 10, thus releasing tip member 26 from grommet 37. The pole can now be transported and stored separately from sheet barrier 12 (FIG. 1) if desired.

SUMMARY, RAMIFICATIONS AND SCOPE

Accordingly the reader will see that I have provided a lent with tent rings axially held along a tube-shaped ring holder, so that a supporting pole can be quickly inserted into the all of the rings in a single step when it is inserted into the ring holder. Several poles are provided for fitting into rings attached to a flexible sheet barrier along several paths. The sheet barrier can be erected by bending the poles into arches, and sliding the rings into position along the poles. As a result, the user can quickly assemble and erect the tent without having to remember the pole paths. The tent can be easily and quickly disassembled by sliding the rings along the poles and locking them onto their ring holders. The poles can be slidably removed from the ring holders, so that the poles and the sheet barrier can be transported separately by two or more people to reduce the load on each person, and also for more compact storage.

Although the above descriptions are specific, they should not be considered as limitations on the scope of the invention, but only as examples of the embodiments. Many other ramifications and variations are possible within the teachings of the invention. For example, the rings can be circular, oval, triangular, polyhedral, etc., instead of D-shaped. The poles can be triangular, square, etc. in section, in lieu of circular. More or fewer poles and rings can be used. Other structures for locking the top ring in the ring holder can be used, such as a pin pushed through a cross-hole above the top ring in the ring holder. More or fewer rings can be used. The rings can be attached directly to the sheet barrier, without using the intermediate webs. Instead of being secured by flaps, the bottom web can be riveted to the ring holder. Instead of a flexible pole, several short sections of rigid poles can be hingably joined together. The materials of all parts can be changed: e.g., the sheet barrier can be made of plastic, nylon, silk, impregnated paper, etc., instead of canvas; the rings and poles can be made of plastic, wood, metal, etc. Therefore, the reader is requested to determine the scope of the invention by the appended claims and their legal equivalents, and not by the examples given.

I claim:

1. A collapsible tent, comprising;

a flexible sheet barrier, a plurality of rings attached to said sheet barrier along a continuous path, an elongated pole for slidably extending through said rings, a tube-shaped ring holder sized for slidably fitting over said pole, said ring holder sized for slidably fitting within said rings for holding said rings in a coaxial stack, and locking means for securely locking said rings on said ring holder when said rings are coaxially positioned thereon, whereby when said rings are fitted and locked onto said ring holder in said coaxial stack, said tent can be easily assembled and erected by slidably fitting said pole into said ring holder, unlocking said locking means, and sliding said rings along said pole, so that said tent is assembled and erected without the need for a user to thread said pole through said rings one at a time or to remember the path of said pole, said tent can also be disassembled by sliding said rings along said pole and slidably tilting and locking said rings onto said ring holder, and removing said pole from said ring holder, so that said pole and said sheet barrier can be stored and transported separately, said rings are kept aligned on said ring holder so that said tent can be easily assembled and erected again.

2. The tent of claim 1 wherein said flexible sheet barrier forms a polyhedral shape when said tent is erect.

3. The tent of claim 1 wherein said rings are generally D-shaped, and said ring holder is D-shaped in cross section for aligning the D-shaped rings thereon.

4. The tent of claim 1 wherein said locking means comprises a locking ring having an inwardly extending locking tab, a slot in said ring holder for receiving said locking tab, and a stop member on a lower end of said ring holder, so that when said rings are coaxially stacked on said ring holder against said stop member, and said locking ring is positioned above the stack of said rings with said locking tab positioned in said slot, said locking ring and said stop member will prevent said rings from separating from said ring holder.

5. The tent of claim 1, further including a rectangular ring extending from a lower end of said ring holder, said rectangular ring including an opposing pair of anti-withdrawal flaps positioned therein for securing a web positioned therethrough, said web attached to a bottom edge of said sheet barrier.

6. The tent of claim 5, further including a tip member attached to one end of said pole, said tip member having a narrow neck portion for engaging a grommet disposed on said web.

7. The tent of claim 5, further including a pair of opposite cutout portions on said anti-withdrawal flaps so as to form a hole for allowing said grammet to pass therethrough.

8. A collapsible tent, comprising;

a flexible sheet barrier, a plurality of rings attached to said sheet barrier along a continuous path, a flexible pole for slidably extending through said rings, a tube-shaped ring holder sized for slidably and coaxially fitting over said pole and within said rings, said ring holder having a stop member disposed adjacent a lower end, and locking means including a locking ring having an inwardly extending locking tab, a slot in said ring holder for receiving said locking tab, and a stop member on a lower end of said ring holder, so that when said rings are coaxially stacked on said ring holder against said stop member, and said locking ring is positioned above the stack of said rings with said locking tab positioned in said slot, said rings are securely locked in said ring holder, said locking ring including a leaf-spring portion deformable for lengthening said locking ring for disengaging said locking tab from said locking slot for releasing said locking ring from said ring holder, whereby when said rings are fitted and locked onto said ring holder in the coaxial stack, said tent can be easily assembled and erected by slidably fitting said pole into said ring holder, deforming and releasing said locking ring from said ring holder, and sliding said rings along said pole, so that said tent is assembled and erected without the need for a user to thread said pole through said rings one at a time or to remember the path of the pole, said tent can also be disassembled and collapsed by sliding said rings along said pole and slidably fitting and locking said rings onto said ring holder with said locking ring, and removing said pole from said ring holder, so that said pole and said sheet barrier can be stored and transported separately, said rings are kept locked and aligned on said ring holder so that said tent can be easily assembled and erected again.

9. The tent of claim 8 wherein said flexible sheet barrier forms a polyhedral shape when said tent is erect.

10. The tent of claim 8 wherein said rings are generally D-shaped, and said ring holder is D-shaped in cross section for aligning the D-shaped rings thereon.

11. The tent of claim 8, further including a rectangular ring extending from said lower end of said ring holder, said rectangular ring including an opposing pair of anti-withdrawal flaps positioned therein for securing a web positioned therethrough, said web attached to a bottom edge of said sheet barrier.

12. The tent of claim 11, further including a tip member attached to one end of said pole, said tip member having a narrow neck portion for engaging a grommet disposed on said web.

13. The tent of claim 11, further including a pair of opposite cutout portions on said anti-withdrawal flaps so as to form a hole for allowing said grommet to pass therethrough.

14. A collapsible tent, comprising;

a flexible sheet barrier, a plurality of rings attached along a plurality of intersecting paths on said sheet barrier, a plurality of elongated poles each for slidably extending through said rings along one of said paths, a plurality of tube-shaped ring holders each sized for slidably fitting onto one of said poles, each of said ring holders includes a stop portion on a lower end thereof, said ring holders each sized for slidably fitting within said rings and holding said rings in a coaxial stack, and locking means for securely locking said rings on each of said ring holders when said rings are coaxially positioned thereon, whereby when said rings are fitted and locked onto said ring holders in said coaxial stacks, said tent can be easily assembled and erected by slidably fitting said poles into said ring holders, unlocking said locking means and sliding said rings along said poles, so that said tent is assembled and erected without the need for a user to thread said poles through said rings at a time or to remember the path of the poles, said tent can also be disassembled and collapsed by sliding said rings along said poles and slidably fitting and locking said rings onto said ring holders, and removing said poles from said ring holders, so that said poles and said sheet barrier can be stored and transported separately, said rings are kept aligned and locked onto said ring holders so that said tent can be easily assembled and erected again.

15. The tent of claim 14 wherein said flexible sheet barrier forms a polyhedral shape when said tent is erect.

16. The tent of claim 14 wherein said rings are generally D-shaped, and said ring holder is D-shaped in cross section for aligning the D-shaped rings thereon.

17. The tent of claim 14, further including a rectangular ring extending from a lower end of each of said ring holders, said rectangular ring including an opposing pair of anti-withdrawal flaps positioned therein for securing a web positioned therethrough, said web attached to a bottom edge of said sheet barrier.

18. The tent of claim 17, further including a tip member attached to one end of each of said poles, said tip member having a narrow neck portion for engaging a grommet disposed on said web.

19. The tent of claim 17, further including a pair of opposite cutout portions on said anti-withdrawal flaps so as to form a hole for allowing said grommet to pass therethrough.

20. A method of providing an erected tent, comprising:

(a) providing a plurality of elongated, flexible tent poles, (b) providing a sheet barrier having a plurality of sets of rings attached thereto, each said set of rings attached at spaced apart locations thereon along a respective pole path on said sheet, (c) providing said plurality of ring holders, each comprising an elongated member having a longitudinal passage therethrough for receiving an end of one of said tent poles, (d) assembling each of said sets of rings onto a respective ring holder, and (e) then bending each of said tent poles into a hoop shape and removing said rings from their respective ring holders and deploying them along their respective poles so as to extend said sheet barrier into a dome-like shape over said poles.

* * * * *